US005298683A

United States Patent [19]

Taylor

[11] Patent Number: 5,298,683

[45] Date of Patent: Mar. 29, 1994

[54] DISSIMILAR METAL CONNECTORS

[75] Inventor: Edward A. Taylor, Roseburg, Oreg.

[73] Assignee: Pacific Coast Technologies, Wenatchee, Wash.

[21] Appl. No.: 817,592

[22] Filed: Jan. 7, 1992

[51] Int. Cl.[5] ..... H05U 01/00

[52] U.S. Cl. ..... 174/152 GM; 174/61; 439/364

[58] Field of Search ..... 174/50, 61, 151, 60.61, 174/152 GM; 439/566, 599, 92, 364

[56] References Cited

U.S. PATENT DOCUMENTS

| | | | |
|---|---|---|---|
| 4,103,619 | 8/1978 | Fletcher et al. | 102/28 R |
| 4,136,603 | 1/1979 | Doyle, Jr. | 92/98 R |
| 4,371,588 | 2/1983 | Kyle | 428/448 |
| 4,493,378 | 1/1985 | Kyle | 174/152 |
| 4,507,522 | 3/1985 | Kyle | 174/152 |
| 4,657,337 | 4/1987 | Kyle | 174/152 |
| 4,690,480 | 9/1987 | Snow et al. | 439/364 |
| 4,934,952 | 6/1990 | Banker | 439/92 |
| 4,950,177 | 8/1990 | Szczesny | 439/405 |
| 5,041,019 | 8/1991 | Sharp et al. | 439/559 |
| 5,109,594 | 5/1992 | Sharp et al. | 29/600 |
| 5,110,307 | 5/1992 | Rapoza | 439/566 |

OTHER PUBLICATIONS

Explosive Fabricators, Inc., trade literature, "The Light Weight of Aluminum and the Seam Sealability of KOVAR", Microwave Journal, p. 141 (Feb. 1991).

Explosive Fabricators, Inc., trade literature, "The Most Powerful Name in Metal Fabrication Technology", (Jul. 1989).

Explosive Fabricators Inc., trade literature "EFTEK Explosion-Clad Materials for Power Hybrid and Microwave Packaging", (undated).

*Primary Examiner*—Leo P. Picard
*Assistant Examiner*—Cheryl R. Figlin
*Attorney, Agent, or Firm*—Stoel, Rives, Boley, Jones & Grey

[57] ABSTRACT

Connectors are provided which afford a substantial material match between two dissimilar metals, such as between an electronics package and the connector as well as between connector components to form an electronics assembly. In this manner, the thermal expansion properties of the electronics assembly components to be interfaced are also substantially matched, thereby allowing maintenance of a hermetic feedthru formed therebetween for a sustained period of operation. Additionally, the substantially matched component materials permit the use of simple and cost effective interfacing procedures in assembly construction.

19 Claims, 4 Drawing Sheets

DISSIMILAR METAL CONNECTORS

TECHNICAL FIELD

The present invention generally relates to apparatus useful for connecting dissimilar metals, employable, for example, in conjunction with electronics packages. More specifically, the present invention relates to apparatus capable of practically and reliably sealing a hermetic feedthru into an electronics package.

BACKGROUND OF THE INVENTION

Practitioners in technological fields involving metal-to-metal interface employ terms of art relevant to the understanding of the present invention and the prior art over which it constitutes an improvement. For example, an explosive weld connotes the metallurgical bond created at the point of impact when one metal is driven against another by the force of an explosion. An explosive weld is distinguished, for example, from a friction weld, i.e., the metallurgical bond created between two metals when they are rubbed together under high pressure conditions. A dissimilar metal sheet is a sheet of metal consisting of two or more layers of dissimilar metal which have been joined together by, for example, explosive or friction welding. A transition bushing is a metal-to-metal interface bushing fabricated from a dissimilar metal sheet.

Similar metals may be interfaced with each other by standard procedures, such as laser welding, soldering or the like. Dissimilar metals, e.g., metals characterized by differing thermal expansion properties, melting point, weld incompatibility or the like, do not reliably interface using such standard procedures. For example, iron cannot be physically laser welded to aluminum, and solder joints between iron and aluminum have a definite thermal fatigue cycle life. As a result, iron-based metal connectors cannot be reliably soldered or laser welded to aluminum electronics packages for sustained periods of operation.

Interface between an aluminum electronics package and a standard iron-based metal connector may be accomplished through the use of a transition bushing fabricated from a dissimilar metal sheet consisting of an iron-based metal and an aluminum alloy. FIGS. 1*a* and 1*b* depict a standard iron-based metal connector 10 and a transition bushing 12, with the former including an integral, patterned arrangement of a plurality of pins, generally formed of iron-based metal, and the latter including an iron portion 14 and an aluminum portion 16. Transition bushing 12 surrounds the perimeter of standard connector 10, with iron portion 14 of transition bushing 12 affixed to a flange 18 of iron-based metal connector 10. After transition bushing 12-connector 10 attachment is accomplished, the combination is installed into an aluminum electronics package (not shown), with aluminum portion 16 of transition bushing 12 affixed to the aluminum electronics package to form an electronics assembly. In this manner, transition bushing 12 serves to provide a similar metal interface for both iron-based metal connector 10 and the aluminum electronics package.

Using transition bushings or like members for installing hermetic feedthrus in an electronics package has a number of drawbacks. Transition bushings require the electronics package-connector interface(s) of an electronics assembly to be large, thereby impacting the space necessary for the connector to be housed within the transition bushing and the bushing, in turn, to be housed within the electronics package. For many applications, this size requirement is unacceptable, because the specified height of an electronics assembly is less than the corresponding dimension of the transition bushing required to house the connector.

Also, transition bushings are designed for use with standard iron-based metal hermetic connectors. Such connectors are relatively heavy, and more disproportionately so when used in combination with a light weight metal electronics package, e.g., an aluminum electronics package. The use of transition bushings adds to the number of electronics assembly components, thereby requiring additional assembly procedures. Moreover, deployment of transition bushings increases the linear length of the hermetic seal and, consequently, decreases the electronics assembly yield. Such problems contribute to the actual and effective cost of the electronics assembly.

Moreover, many standard iron-based metal connectors and/or transition bushings employed therewith are formed, at least in part, using magnetic iron-based metals. Such fabrication materials produce connectors having magnetic properties, which are undesirable in some connector applications. Also, the use of iron connecting pins limits the amount of current that a connector is capable of handling.

FIGS. 1*c* and 1*d* depict prior art radio frequency (RF) connectors, with FIG. 1*c* constituting a "spark plug" type and FIG. 1*d* constituting a "field replaceable" type. FIG. 1*c* shows a RF connector 10' with a hollow, exteriorly threaded stainless steel shell 12' having a KOVAR® glass-to-metal feedthru 14' affixed thereto by brazing at elevated temperature. Shell 12' also houses a teflon insert 16' having a pin socket 18' disposed therein at each longitudinal end thereof. A connector pin 20', generally formed of iron-based metal, inserts into pin socket 18'. A teflon member 22' surrounds connector pin 20' in longitudinal juxtaposition to shell 12', and a double knife edge seal ring 24' is disposed in circumferential juxtaposition to shell 12'. Ring 24' is formed of an iron-based metal, such as KOVAR® or stainless steel, and is optionally coated with silver.

To affix RF connector 10' to an interiorly threaded electronics package 26', torque (approximately 25 in-lbs) is applied to connector 10'. This force causes seal ring 24' to slightly cut into both connector 10' and electronics package 26', thereby creating a seal. To insure that connector 10' does not back out of electronics package 26' during transport or use, an edge 28' of a connector 10'-electronics package 26' assembly is soldered about the circumference of connector 10'. For this purpose, gold plating is optionally used to improve the wetting properties of the solder.

This seal is not a reliable hermetic seal, however. The two dissimilar metals, i.e., the externally threaded iron-based metal and the internally threaded aluminum metal, are in intimate contact at ambient temperature. Since aluminum has a higher expansion rate than KOVAR® or stainless steel, temperatures lower than ambient cause package 26' to squeeze connector 10', while temperatures higher than ambient produce a separation between those components. Such phenomena result in fatigue of the solder joint during thermal cycle and cause less than intimate contact between seal ring 24' and electronics package 26' and between seal ring 24' and connector 10'. The external solder application at 28' to prevent connector 10' backout provides a mechanical lock between the components rather than a hermetic seal. The connector is not field replaceable because removal thereof compromises the hermeticity of the package and breaks the rigid connection to the end of the pin located inside the package. That is, connector 10' cannot be replaced in the field without a high risk of electronics package 26' circuitry compromise.

In addition, the electrical performance of RF connector 10' suffers as a result of temporal separation between the communication of the signal and the ground to electronics package 26'. The signal follows an essentially straight line path through connector 10' into electronics package 26'. In contrast, the ground path runs along the outer surface of teflon insert 16', the outer surface of the glass portion of feedthru 14', the outer surface of teflon member 22', through seal ring 24' into electronics package 26' and about the periphery of the interior of package 26' to the ground location therewithin. The ground lag caused by the disparity in signal/ground path lengths impacts signal gain and loss characteristics, thereby affecting the signal-to-noise ratio. This problem is exacerbated as higher frequency signals are employed.

A "field replaceable" RF connector 30', as shown in FIG. 1*d*, includes an exteriorly threaded, replaceable portion 32' formed of stainless steel. A KOVAR® glass-to-metal feedthru 34' is soldered into a cavity 36' in an aluminum electronics package 38' at one or more solder locations 40'. Replaceable portion 32' is torqued into an interiorly threaded aluminum portion 42'.

KOVAR® and aluminum exhibit an approximately 4:1 thermal expansion mismatch. As a result, seals using field replaceable connectors 30' are hermetic at ambient temperature only. The KOVAR®-aluminum solder seal fails during thermal cycle. Moreover, connector 30' does not meet military field replaceability standards (i.e., an iron-based metal part may be threaded into aluminum only once, because that operation impacts subsequent torque applications by displacing the aluminum in the threaded area).

As discussed with respect to prior art micro-D connector designs, the use of a magnetic material, such as KOVAR® or the like, in fabricating connectors imparts magnetic properties thereto. Such properties are not desirable in all connector applications.

SUMMARY OF THE INVENTION

The present invention features substantial material matching between dissimilar metals, for example, between an electronics package and at least one inventive connector to form an electronics assembly as well as between inventive connector components. In this manner, the thermal expansion properties of the components of an electronics assembly to be interfaced are also substantially matched, thereby allowing maintenance of a hermetic feedthru formed therebetween for a sustained period of operation. Additionally, the substantially matched component materials permit the use of simple and cost effective interfacing procedures in assembly construction.

An embodiment of the present invention provides a connector formed of at least two dissimilar metals and capable of sealing a hermetic feedthru into an electronics package at least partially formed of one of those dissimilar metals or a metal compatible therewith. Micro-D, low profile micro-D, unitary RF, field replaceable RF and like connectors may be configured in accordance with the present invention. Feedthrus, such as D.C. feedthrus or the like, may also be configured in accordance with the present invention. Connectors and feedthrus of the present invention are preferably formed from dissimilar metal sheets, with each such sheet having the majority of its thickness formed of the same metal as, or a metal compatible with, that forming the electronics package to which the connector or feedthru is to be interfaced.

A preferred embodiment of the present invention provides a connector capable of sealing a hermetic feedthru into an aluminum electronics package. This embodiment involves a connector formed of aluminum or an aluminum alloy capable of interfacing with an aluminum electronics package (directly), and an iron-based metal capable of interfacing with at least one pin (indirectly through a pin insert or a "traditional feedthru" component formed at least partially of iron-based metal). Such connectors are preferably fabricated from dissimilar metal sheets having at least one aluminum layer and at least one iron-based metal layer, with the aluminum layer(s) constituting the majority of the sheet thickness. Stainless steel is a generally preferable iron-based metal for use in the practice of embodiments of the present invention employing ceramic-to-metal feedthru components, while KOVAR® is generally preferred for use in embodiments employing glass-to-metal feedthru components.

Connectors of the present invention obviate the problems exhibited by prior art connector-transition bushing combinations. More specifically, a smaller electronics package-connector interface area is required; less weight is exhibited by the inventive connectors than the standard iron-based metal connectors employed with transition bushings; and decreased hermetic seal linear length is exhibited by electronics assemblies employing the inventive connector. Fewer component parts and, therefore, fewer assembly steps are required to manufacture and utilize connectors of the present invention than are necessary for the connector-transition bushing assemblies employed previously. These factors contribute to a lower relative actual and effective cost of the connectors of the present invention.

Micro-D embodiments of the present invention exhibit the following advantages and structural features: chrome-copper pin utilization capability; large current handling capability; laser weldability to aluminum alloy; individual feedthrus for each pin; light weight; small size; and low magnetic (e.g., stainless steel/nickel plating) or non-magnetic (e.g., stainless steel/no plating or rhodium plating) design options; and the like. Low profile micro-D embodiments of the present invention provide the additional advantage of reduced height.

Unitary RF embodiments of the present invention exhibit the following advantages: light weight; usefulness with electronics packages having thinner walls; laser weldability; improved electrical properties; and the like. Field replaceable RF embodiments of the present invention exhibit the following advantages: field replaceability; laser weldability; improved electrical performance; higher frequency signal handling capability; and the like.

BRIEF DESCRIPTION OF THE DRAWINGS

The above-mentioned and additional features of the present invention and the manner of obtaining them will become apparent, and the invention will be best understood by reference to the following more detailed description, read in conjunction with the accompanying drawings in which.

DESCRIPTION OF PREFERRED EMBODIMENTS

As used herein, the term "thickness" connotes the dimension of a connector aligned with the plane of the dissimilar metal sheet from which the connector is fabricated, while the term "height" connotes the dimension of a connector aligned with the transverse plane thereof. As used herein, the term "connector body" connotes the main body of a connector; the term "connector" connotes the main body of a connector, with a pin insert or other pin interface, such as a feedthru, in place; the term "electronics package" connotes one of the components with which the connector is to interface; and the term "electronics assembly" connotes the interfaced connector-electronics package assembly.

The present invention achieves practical and reliable installation of hermetic feedthrus into electronics packages by substantially matching the material or thermal expansion properties of the electronics package to the corresponding parameter(s) of the inventive connector. Preferably, similar property matching is also achieved between connector components. Although the present invention is described below in terms of accomplishing aluminum electronics package-iron-based metal component interface, one skilled in the art would appreciate that the principles of the present invention may be employed in other dissimilar metal applications, involving metals such as titanium and the like.

As a result of the substantial thermal expansion property matching between the electronics assembly component when a connector of the present invention is employed, solder fatigue failure is avoided. Also, laser welding may be used for electronics package-connector body-pin insert interface as a result of substantial component material matching along at least a portion of the juxtaposed surfaces thereof. Consequently, simple interface procedures, such as laser welding, soldering or the like, may be employed in the practice of the present invention to form electronics assemblies.

Figure 1A:
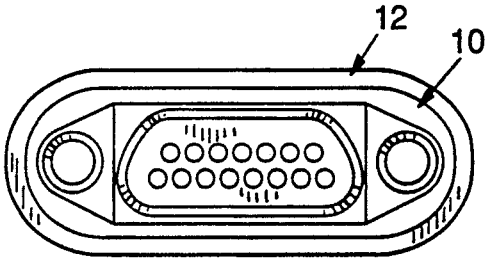
FIG. 1a Prior Art
FIG. 1*a* is an end view of a prior art standard iron-based metal connector having a transition bushing disposed therearound.
Figure 1B:
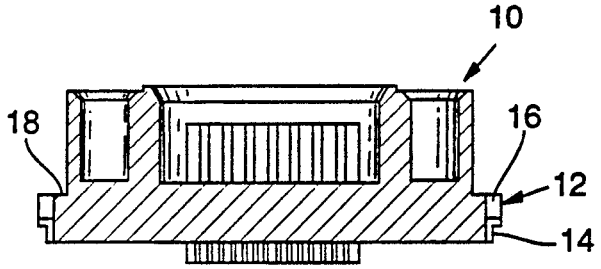
FIG. 1b Prior Art
FIG. 1*b* is a partial cross-sectional view of the prior art standard iron-based metal connector-transition bushing assembly shown in FIG. 1*a;*
Figure 1C:
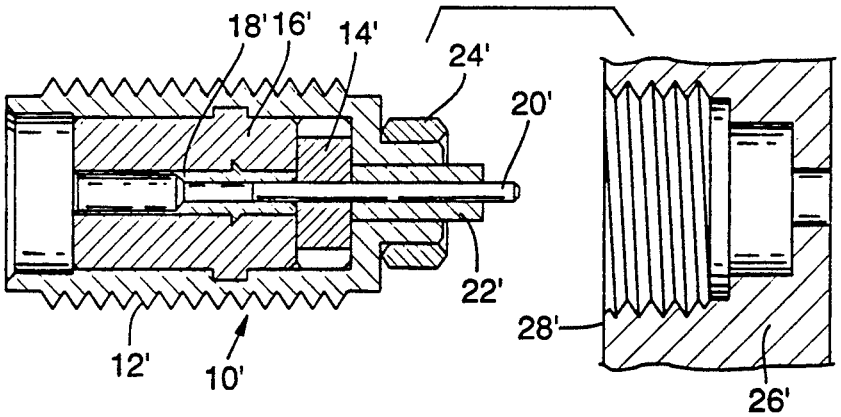
FIG. 1c Prior Art
FIG. 1*c* is a cross-sectional view of a prior art radio frequency (RF) connector.
Figure 1D:
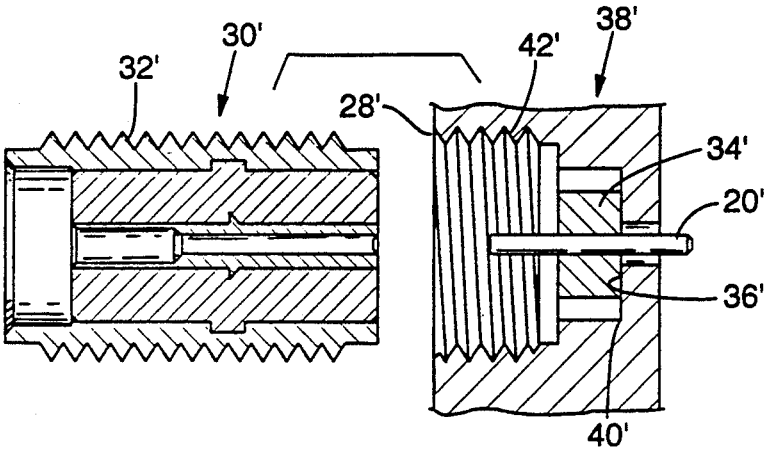
FIG. 1d Prior Art
FIG. 1*d* is a cross-sectional view of another prior art RF connector.
Figure 2A:
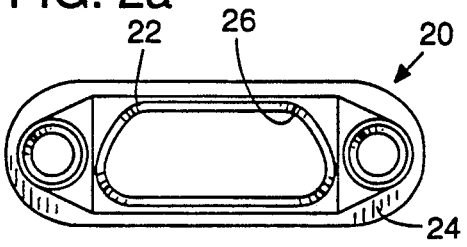
FIG. 2*a* is an end view of an embodiment of the main body of a connector of the present invention.
Figure 2B:
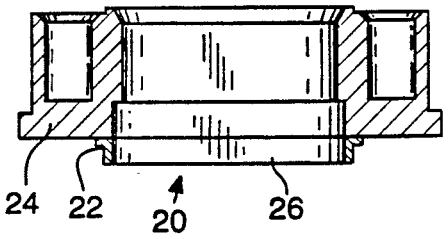
FIG. 2*b* is a partial cross-sectional view of the embodiment of the main body of the connector shown in FIG. 2*a;*

FIGS. 2*a* and 2*b* depict an embodiment of a connector body 20 of the present invention (a micro-D connector embodiment), including an iron-based metal portion 22 and an aluminum portion 24. A housing portion 26 of connector body 20 accommodates a pin insert (shown in FIG. 3). As can be ascertained from FIGS. 2*a* and 2*b*, the amount of light weight aluminum or aluminum alloy employed forming connector body 20 is greater than the amount of the heavier iron-based metal.

Connector body 20 may be sized and configured in any standard micro-D design to interface with a micro-D connector compatible electronics package. In addition, connector body 20 is preferably sized and configured to perform all of the normal functions of a standard connector. Moreover, housing portion 26 may be sized and configured to accommodate pin inserts 30 exhibiting a variety of standard pin patterns.

Connector body 20 is preferably fabricated from a dissimilar metal sheet produced by explosive welding, friction welding or the like, with explosive welding preferred. Standard processes for preparing dissimilar metal sheets may be employed for this purpose. Dissimilar metal sheets useful in the practice of the present invention are known and commercially available from, for example, Explosive Fabricators Inc. (Louisville, Colo.).

Dissimilar metal sheet fabrication provides connector body 20 with dissimilar metal interface capabilities. To provide reliable dissimilar metal interface within an electronics assembly, the dissimilar metal sheet from which connector body 20 is fabricated exhibits appropriate dissimilar metal layer materials and thicknesses.

For example, a dissimilar metal sheet forming connector body 20 may include an aluminum layer, formed of at least one sublayer of aluminum, an aluminum alloy, such as aluminum alloy 4047, aluminum alloy 6061 and the like, or the like. If more than one sublayer of aluminum is used, an alloy that is readily weldable or otherwise affixable (e.g., aluminum alloy 4047) is located on the dissimilar metal sheet at a position that ultimately constitutes the electronics package attachment location of connector body 20. In this manner, a more easily machinable, but less easily affixable, aluminum alloy (e.g., aluminum alloy 6061) may be used as the primary aluminum component of connector body 20.

Dissimilar metal sheets useful in the practice of the present invention also include an iron layer formed, for example, of at least one sublayer of an iron-based metal, such as a nickel-iron-cobalt alloy marketed under the trademark KOVAR ®, iron alloy 52, stainless steel, or the like. Stainless steel, such as 304L stainless steel, is preferably used in embodiments of the present invention when low magnetic connector bodies 20 are desired. In addition to being non-magnetic, 304L stainless steel also exhibits the advantageous properties of relative softness and easy machinability.

Other metallic layers may optionally be employed in a dissimilar metal sheet forming connector body 20, such as titanium, silver, palladium, or the like. These additional metals prevent or reduce intermetallic growth at elevated temperatures between dissimilar metal sheet layers susceptible thereto, e.g., KOVAR ® and 4047 or 6061 aluminum, by serving as an inert boundary layer therebetween. An inert aluminum alloy, such as aluminum alloy 1100 or the like, may also be used for this purpose.

Preferably, the thickness of the aluminum layer of a dissimilar metal sheet forming connector body 20 of the present invention ranges from about 0.040 in. to about 0.500 in., with from about 0.040 in. to 0.250 in. more preferred. Similarly, the preferable thickness of the iron layer ranges from about 0.020 in. to about 0.060 in., with from about 0.030 in. to 0.040 in. more preferred. The thickness of the optional metallic layer (e.g., titanium or the like) of a dissimilar metal sheet preferably ranges from about 0.005 in. to about 0.060 in., with from about 0.010 in. to about 0.030 in. more preferred.

Exemplary dissimilar metal sheets useful in the practice of the present invention are as follows: (1) 0.312 in. aluminum alloy 6061, 0.060 in. aluminum alloy 4047 and 0.060 in. stainless steel 304L; (2) 0.060 in. aluminum alloy 4047, 0.200 in. aluminum alloy 6061, 0.030 in. titanium and 0.060 in. stainless steel 304L; (3) 0.077 in. aluminum alloy 4047, 0.213 in. aluminum alloy 6061, 0.017 in. aluminum alloy 1100 and 0.053 in. stainless steel 304L; and the like.

Connector body 20 therefore preferably ranges in total thickness from about 0.300 in. to about 0.350 in., with about 0.320 in. preferred. Seal depths (i.e., the thickness of portions of connector body 20 to be welded or otherwise affixed to other components of an electronics assembly) employed in the practice of this embodiment of the present invention are about 0.100 in. These parameters are within the design specifications of micro-D connectors (e.g., Military Standard 83513), allowing connector bodies 20 of the present invention to be used in applications requiring such connectors.

Figure 3A:
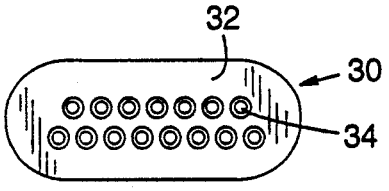
FIG. 3*a* is an end view of an embodiment of a pin insert component useful in the practice of the present invention.
Figure 3B:
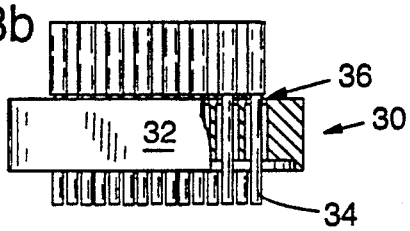
FIG. 3*b* is a partial cross-sectional view of the embodiment of the pin insert component shown in FIG. 3*a;*
Figure 3C:
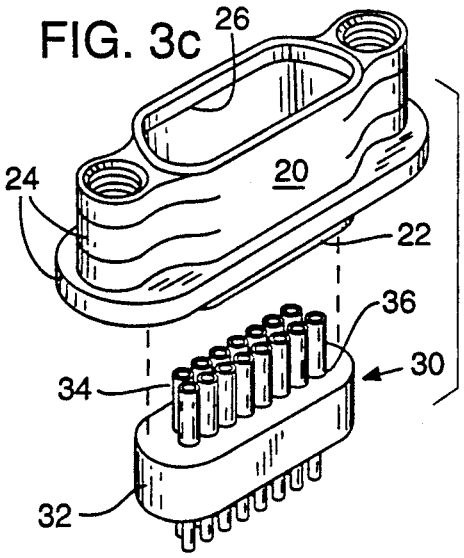
FIG. 3*c* is an isometric view of a main body and pin insert of an embodiment of a connector of the present invention.

A micro-D connector embodiment of the present invention involves a two part assembly, with connector body 20 shown in FIGS. 2*a* and 2*b* constituting one component and a pin insert 30 shown in FIGS. 3*a* and 3*b* constituting the other. A main body 32 of pin insert 30 is preferably fabricated from a ceramic/glass-to-metal sealing iron-based metal, such as KOVAR ®, stainless steel or the like. Main body 32 interfaces with at least one hermetically sealed pin 34 through a number of ceramic/glass-to-metal feedthrus 36 which preferably corresponds to the number of pins 34 to form pin insert 30. Stainless steel is preferred for fabricating main bodies 32 to be used with ceramic-to-metal feedthrus 36, with 304L stainless steel being more preferred. One reason for this preference is that stainless steel is non-magnetic.

Any standard pin pattern and pin construction for micro-D connectors may be employed in the practice of the present invention. For example, 9, 15, 21, 25, 31 or 37 pin, dual row patterns may be employed in the formation of pin inserts of micro-D embodiments of the present invention. Standard two or three row pin patterns, such as Military Standard 28748, may be employed in the practice of the present invention as well. Standard pin materials, such as iron or the like, may be used to form pins for use in accordance with the present invention. Preferred embodiments of the present invention, employ ceramic-to-stainless steel feedthrus and chrome-copper pins (e.g., 1% by weight chromium/99% by weight copper pins). The ability to employ chrome-copper pins, for example, enhances the current handling capability of the connector of the present invention (e.g., increases the potential throughput to approximately 10 amperes per pin).

In addition, any standard glass-to-metal or ceramic-to-metal feedthru may be employed for micro-D connectors of the present invention. Ceramic-to-metal feedthrus, using any ceramic conventionally employed for this purpose, are preferred for use with stainless steel. A ceramic KRYOFLEX ®, described in U.S. Pat. No. 4,352,951, is especially preferred.

Ceramic-to-metal or glass-to-metal feedthrus may be produced using known techniques and equipment therefor, such as the sealing procedure outlined in U.S. Pat. No. 4,352,951 or the like. In accordance with this preferred sealing technique, an individual hole is provided for each pin. A ceramic bead is installed between the outer surface of the pin and the inner surface of the hole. If the metal body does not include individual holes, glass may be poured between the outer surface of the pin and the inner surface of the slot. A multiple individual seal pin insert design enhances the mechanical strength of the connectors of the present invention. A practitioner in the art is therefore capable of producing pin inserts 30 useful in the practice of the present invention.

Figure 4:
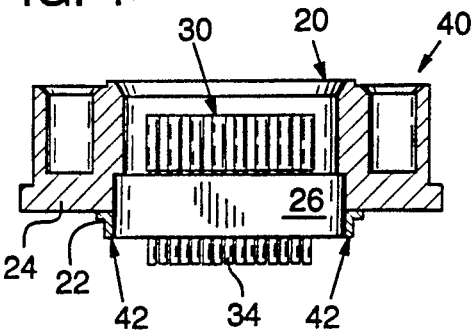
FIG. 4 is a partial cross-sectional view of an embodiment of a connector of the present invention, including the main body shown in FIGS. 2*a* and 2*b* and the pin insert shown in FIGS. 3*a* and 3*b;*

FIG. 4 depicts an aluminum compatible micro-D connector 40, having pin insert 30 installed in connector body 20. Such installation may be conducted using laser welding techniques at one or more laser weld locations 42, where iron-based metal portions 22 serve as laser weld flanges. Upon installation and laser welding, aluminum compatible micro-D connector 40 constitutes a hermetic unit. Standard laser welding techniques and equipment may be employed for this purpose. Known pre- and post-weld processes may be employed, if desired. For example, boron electroless nickel plating, low phosphorus nickel plating, electrolytic nickel plating, gold plating, silver plating or the like may be employed, with boron electroless nickel plating generally preferred. The precise pre- and post-weld processes selected are generally determined by the characteristics of the connector which are desirable in the anticipated environment of its use. If the preferred ceramic-to-glass seals and electrolytic nickel plating are employed, the ceramic must be masked prior to plating and the mask removed thereafter. Since nickel plating is magnetic, non-magnetic, yet plated, connectors of the present invention may be prepared using rhodium plating or no plating at all. Such plating may be conducted, for example, by known techniques or commercial vendors, such as Titanium Finishing Company (East Greenville, Pa.).

In addition, the portions of a plated connector body 20 that are to be affixed to an electronics package may be treated to remove the plating therefrom, if desired. Such removal may be achieved by a secondary machining process or the like. Alternatively, such plating may initially be avoided by masking the affixation connector body 20 portions prior to plating or the like. Secondary machining is preferred for this purpose. A practitioner in the art is therefore capable of producing connectors 40 of the present invention, including connector body 20 and pin insert 30.

Figure 5:
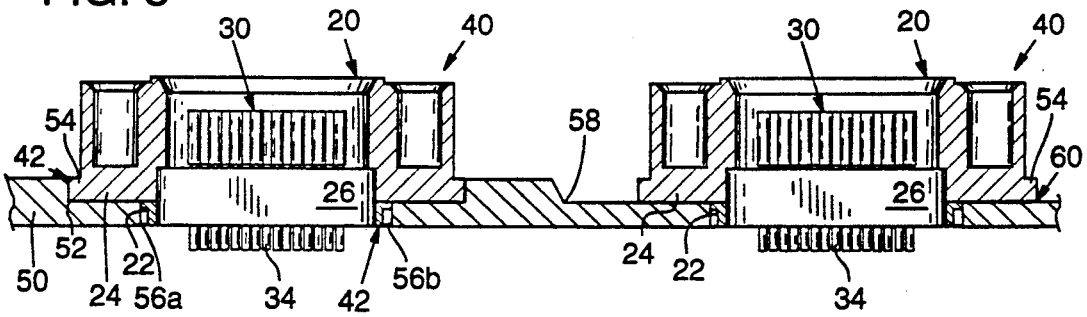
FIG. 5 is a partial cross-sectional view of two connectors of the embodiment of the present invention shown in FIG. 4 installed in an electronics package by laser welding (the leftmost connector) and soldering (the rightmost connector)

Hermetic, aluminum compatible micro-D connector 40 is capable of interfacing with an aluminum electronics package in any convenient manner therefor. As shown in FIG. 5, this interface may be achieved, for example, by laser welding (i.e., the interface exhibited by the leftmost connector 40) or by soldering (i.e., the interface exhibited by the rightmost connector 40). The left portion of FIG. 5 shows a wall 50 of an electronics package exhibiting, for example, one or more fitted inserts 52, each sized and configured to accommodate an attachment flange 54 of micro-D connector 40. Also, fitted inserts 52 serve to bound an opening in electronics package wall 50, shown by wall portions 56*a* and 56*b*. Each such opening is sized and configured, in the depicted embodiment, to accommodate connector 40. Laser welds are performed at one or more laser weld locations 42 to form a hermetic seal between connector 40 and electronics package wall 50.

Preferably, the aluminum alloy forming the portion of connector body 20 at laser weld locations 42 is readily amenable to laser welding. For example, aluminum alloy 4047 readily welds to aluminum alloy 6061, while aluminum alloy 6061 does not readily weld to itself. Consequently, aluminum alloy 4047 is a preferred material for forming the portion of connector body 20 at laser weld locations 42.

Standard laser welding techniques, including pre- and post-weld processes, and equipment may be employed for this purpose. A practitioner in the art is therefore capable of producing a connector-electronics package interface to form an electronics assembly in accordance with the present invention.

Alternatively or additionally and as shown in the rightmost portion of FIG. 5, wall 50 may exhibit one or more indentations 58, each sized and configured to accommodate an attachment flange 54, for example, of micro-D connector 40. Also, indentations 58 serve to bound an opening in electronics package wall 50, shown by wall portions 56*a* and 56*b*. Indentations 58 provide one or more exposed solder joint locations 60 at the interface of the outer wall of attachment flange 54 and electronics package wall 50. A hermetic seal may therefore be formed between connector 40 and electronics package wall 50 by application of soldering techniques. No particular aluminum alloy is preferred in forming the portion of connector body 20 at solder joint locations 60, because individual aluminum alloys are generally amenable to soldering to themselves or to other aluminum alloys.

Standard soldering techniques and equipment may be employed for this purpose. Any known pre- or post-solder processing may be employed in the practice of the present invention, if desired. For example, the parts to be soldered may be plated with nickel and/or gold or the like prior to soldering. A practitioner in the art is therefore capable of producing a connector-electronics package interface to form an electronics assembly in accordance with the present invention.

For some applications of the present invention, soldering is preferred, as a result of the relative ease of reworking the connector-package interface in comparison to reworking an interface formed, for example, by laser welding. Also, the reliability of an interface formed by soldering metals of substantially matched coefficients of thermal expansion is extremely high, resulting in years of dependable service.

An exemplary procedure to accomplish assembly and installation of connector 40 of the present invention includes the following steps:

(1) Installing pins into the pin insert through the use of ceramic/glass-to-metal feedthrus;

(2) Boron electroless nickel plating of the connector body;

(3) Laser welding the pin insert to the plated connector body;

(4) Masking the ceramic, if the preferred ceramic-to-metal seals are used (glass does not take electrolytic plating, thereby rendering a masking step unnecessary);

(5) Electrolytically nickel plating the masked pin insert-connector body assembly;

(6) Removing the mask from the ceramic, if ceramic-to-metal seals are used; and (7) Installing the connector into an electronics package by laser welding, soldering or the like.

Alternatively, the connector body can be formed with no plating or with additional or alternative plating, such as silver plating, gold plating or the like. Also, plating may be prevented or subsequently removed from affixation locations of the connector prior to step (7). Finally, additional processing steps may be employed as desired to produce electronics assemblies having advantageous characteristics.

Connectors 40 fabricated by the above-described process or an equivalent process thereto preferably exhibit one or more of the following characteristics and structural features: chrome-copper pin utilization capability; large current handling capability; laser weldability to aluminum alloy; individual feedthrus for each pin; light weight; small size; and low magnetic (e.g., stainless steel/nickel plating) or non-magnetic (e.g., stainless steel/no plating or rhodium plating) design options; and the like.

Figure 6A:
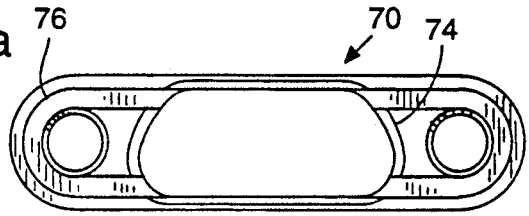
FIG. 6*a* is an end view of another embodiment of the main body of a connector of the present invention.
Figure 6B:
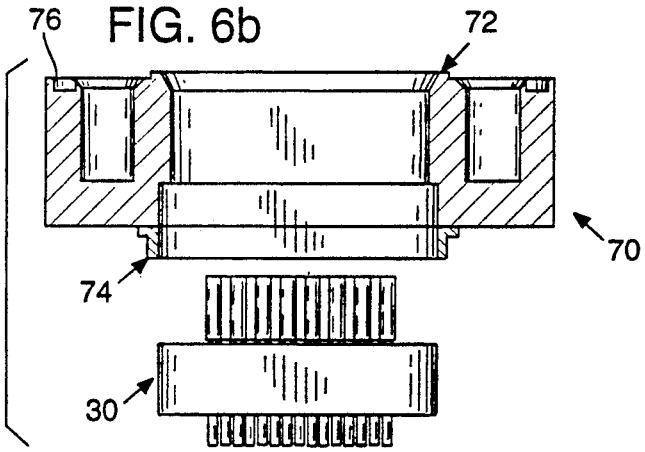
FIG. 6*b* is a partial cross-sectional, exploded view of the embodiment of a connector of the present invention including the main body shown in FIG. 6*a* and a pin insert to be installed by laser welding.

Connector designs other than the previously described micro-D design may benefit from the application of the principles of the present invention. For example, FIGS. 6*a* and 6*b* depict a low profile micro-D connector 70 fabricated in accordance with the present invention and designed with a preference for laser weld electronics package installation. Low profile connector 70 includes a main body 72 and a pin insert 30 and exhibits one or more iron-based metal laser weld flanges 74 and one or more aluminum alloy laser weld flanges 76. When laser welded in place, connector 70 may be substantially flush with the electronics package into which it is inserted.

Standard laser welding techniques and equipment may be employed for this purpose. Known pre- and post-weld techniques may be employed in the practice of the present invention, if desired. A practitioner in the art is therefore capable of producing a connector-electronics package interface to form an electronics assembly in accordance with this embodiment of the present invention.

Figure 7:
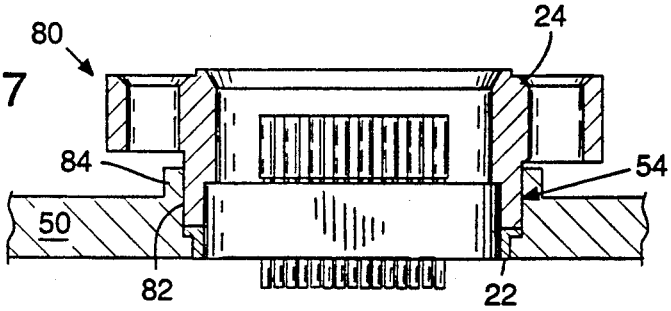
FIG. 7 is a partial cross-sectional view of an embodiment of a connector of the present invention as installed in an electronics package by soldering.

FIG. 7 shows a low profile micro-D connector 80 designed with a preference for solder installation, as installed in wall 50 of an electronics package. This installation may be accomplished by soldering at one or more solder joint locations 54, where a solder flange 82 interfaces with a portion 84 of electronics package wall 50 protruding outward from the main body thereof. Solder joint locations 54 are selected, such that wall 50 interfaces with connector 80 in compression, rather than in sheer or in tension.

Standard soldering techniques and equipment may be employed for this purpose. Known pre-or post-solder processes may be employed in the practice of the present invention, if desired. A practitioner in the art is therefore capable of producing a connector-electronics package interface to form an electronics assembly in accordance with this embodiment of the present invention.

Low profile micro-D connectors 70 and 80 may be sized and configured in any standard low profile micro-D arrangement to interface with a low profile micro-D connector compatible electronics package. In addition, low profile micro-D connectors 70 and 80 are sized and configured to perform all of the normal functions of a standard connector. Moreover, such connectors of the present invention may be sized and configured to accommodate pin inserts exhibiting a variety of standard pin patterns.

In addition to exhibiting the advantages recited above for micro-D connectors of the present invention, low profile micro-D connectors are generally shorter than micro-D connectors. For example, micro-D connectors generally range from about 0.300 in. to about 0.400 in. in height, while low profile micro-D connectors generally exhibit heights ranging from about 0.225 in. to about 0.300 in. The considerations involved in pin insert assembly and installation as well as connector-electronics package interface and electronic assembly operation are the same or similar for micro-D and low profile micro-D connectors.

The same or similar dissimilar metal sheets used in fabricating micro-D connectors may be used in fabricating low profile micro-D connectors. When laser welding is to be used for low profile micro-D connectors, the portion of the structure thereof to be laser welded to an electronics package differs from that of typical micro-D connector designs. As a result, the preferred location of a readily laser weldable aluminum layer in dissimilar metal sheets used to fabricate low profile micro-D connectors differs from the location thereof in sheets used in the fabrication of typical micro-D connectors (compare FIG. 5 to FIGS. 6*a* and 6*b*, for example). In embodiments of the low profile micro-D connector of the present invention designed primarily for soldering (e.g., the connector shown in FIG. 7), a readily weldable aluminum alloy layer need not be employed.

Figure 8:
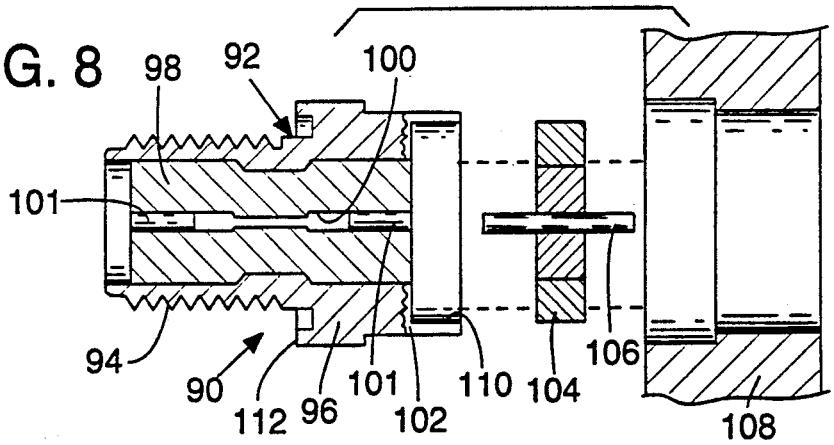
FIG. 8 is a partial cross-sectional, exploded view of an additional embodiment of a connector of the present invention.

FIG. 8 depicts a single component RF connector 90 embodiment of the present invention. Unitary RF connector 90 is characterized by an aluminum portion 92, including an exteriorly threaded portion 94 and an attachment portion 96. Aluminum portion 92 houses a pin accepting member 98 formed of any suitable material therefor, such as teflon or other like dielectric materials. Pin accepting member 98 exhibits a pin accepting channel 100 housing a pin socket 101 at each longitudinal end thereof. Attachment portion 96 may be larger in circumference than threaded portion 94 as shown in FIG. 8 and is preferably formed integrally with an iron-based metal housing portion 102. Attachment portion 96 and housing portion 102 are preferably formed from a dissimilar metal sheet, with threaded portion 94 optionally so formed. A feedthru 104 (e.g., a glass-to-metal seal) housing a pin 106 is sized and configured for placement within housing portion 102, such that pin 106 is aligned with accepting channel 100 and contained within pin socket 101. A preferred iron-based metal for this purpose is KOVAR®.

Attachment of feedthru 104 to unitary RF connector 90 may be achieved through laser welding, soldering or the like of the interior surface of iron-based metal housing portion 102 and the exterior surface of feedthru 104. Attachment to an aluminum electronics package 108 may be accomplished through laser welding, soldering or the like of aluminum attachment portion 96 and aluminum electronics package 108. For example, housing portion 102 may exhibit one or more laser weld flanges 110, while attachment portion 96 may exhibit one or more laser weld flanges 112.

The electrical performance of unitary RF connector 90 exceeds that of prior art connectors of similar design. RF connector 90 is characterized by a similar, essentially straight line signal path in comparison to prior art RF connectors, while exhibiting a shorter ground path. The ground path of connector 90 is along the outer surface of pin accepting member 98, along the outer surface of the glass portion of feedthru 104 and into electronics package 108. An even shorter ground path may be generated by using a glass-to-metal feedthru 104 characterized by a glass portion of smaller width (i.e., length in the radial direction of connector 90). Further improvements in electrical performance may be achieved in accordance with the principles discussed below with respect to FIG. 10 (i.e., the use of a ground shim and/or a ground pin).

Glass-to-metal feedthrus useful in the practice of the present invention are known and commercially available. Glass-to-metal feedthrus formed, for example, from 7070 glass available from Corning Glass Works (Corning, N.Y.) and KOVAR® may be produced substantially as described in U.S. Pat. No. 4,352,951. Size modification of commercial feedthrus may be necessary to best accommodate all applications of the present invention. Such modifications may be made by a practitioner in the art, however.

Laser welding, soldering, brazing or like techniques and equipment may be employed for this purpose, with laser welding preferred. In addition, any known pre- or post-weld or solder production steps may be employed, if desirable for the specific application in which the connector of the present invention is to be used. A practitioner in the art is therefore capable of producing a connector-electronics package interface to form an electronics assembly in accordance with this embodiment of the present invention.

Generally, unitary RF connector 90 dimensions are related to the thickness of the wall of the electronics package with which connector 90 is to interface. Conventional RF connectors interface with 0.250 in. thick electronics package walls. Connectors 90 of the present invention are capable of interfacing with thinner electronics package walls, e.g., walls from about 0.100 in. to 0.125 in. thick. Another factor influencing unitary RF connector 90 dimensions (especially the longitudinal length of exteriorly threaded portion 94) is the interface between connector 90 and a component external to the electronics package. More specifically, connector 90 must be of a design compatible with external components to provide electrical communication between such components and components housed within the electronics package.

Preferably, unitary RF connector 90 is formed of a dissimilar metal sheet having an aluminum layer thickness ranging from about 0.400 in. to about 0.600 in., with about 0.400 in. to about 0.500 in. more preferred, and an iron layer thickness preferably ranging from about 0.010 in. to about 0.200 in., with from about 0.080 in. to about 0.100 in. more preferred. Additional metal layers that may be optionally included in dissimilar metal sheets forming unitary RF connectors 90 useful to accomplish aluminum-to-iron interface are titanium, silver, palladium or the like. Such additional metal layers preferably range from about 0.025 in. to about 0.030 in. in thickness. The total length of unitary RF connector 90 therefore ranges from about 0.400 in. to about 0.650 in.

These dimensions are within the design parameters of standard RF connectors, allowing the connectors of the present invention to be used in applications requiring such connectors. The same or similar dissimilar metal sheets used in fabricating micro-D connectors may be used to fabricate unitary RF connector 90 of this embodiment of the present invention. Preferably, the dissimilar metal sheets used in this embodiment of the present invention are formed with aluminum alloy/KOVAR® or aluminum alloy/stainless steel layers. Exemplary dissimilar metal sheets for this purpose are (1) 0.060 in. aluminum alloy 4047, 0.030 in. titanium and 0.250 in. stainless steel 304L and (2) 0.075 in. aluminum alloy 4047, 0.017 in. aluminum alloy 1100 and 0.250 in. KOVAR®.

Optionally, threaded portion 94 may be configured to provide "push on" type interface with external components (as opposed to the internal components housed in the electronics package). In this manner, a large portion of connector 90 may be formed of aluminum, while avoiding the limitations of the military standard with respect to iron-based metal-aluminum alloy threaded engagement.

Unitary RF connectors 90 fabricated in accordance with the present invention exhibit the following properties: light weight; usable with thinner electronics package walls; laser weldable; improved electrical properties; and the like.

Figure 9:
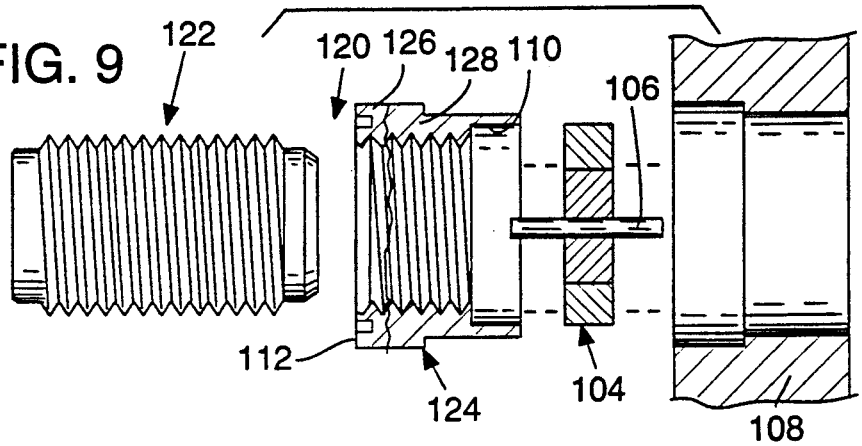
FIG. 9 is a partial cross-sectional, partially exploded view of an additional embodiment of a connector of the present invention.

FIG. 9 depicts a field replaceable RF connector 120 embodiment of the present invention. One component of connector 120 is a field replaceable, exteriorly threaded member 122. Such threaded members 122 are known and commercially available. A second component 124 of connector 120 includes an aluminum portion 126 and an iron-based metal portion 128. Both aluminum portion 126 and iron-based metal portion 128 are interiorly threaded, with the majority of the threads preferably formed of the iron-based metal to minimize the problems associated with threading iron-based metal into aluminum. Iron-based metal portion 128 is preferably formed integrally with aluminum portion 126 at one longitudinal end thereof and sized and configured to accommodate a feedthru 104 (e.g., a glass-to-metal seal) at the opposed end. Iron-based metal portion 128 and aluminum portion 126 are preferably formed from a dissimilar metal sheet. A preferred iron-based metal for this purpose is KOVAR®.

Operable connection of exteriorly threaded member 122 and second component 124 may be achieved by application of torque. Attachment of feedthru 104 may be achieved through laser welding, soldering or the like of the interior surface of iron-based metal portion 128 and the exterior surface of feedthru 104. Attachment to aluminum electronics package 108 may be accomplished through laser welding, soldering or the like of aluminum portion 126 and aluminum electronics package 108. For example, iron-based metal portion 128 may exhibit one or more laser weld flanges 110, while aluminum portion 126 may exhibit one or more laser weld flanges 112.

Figure 10:
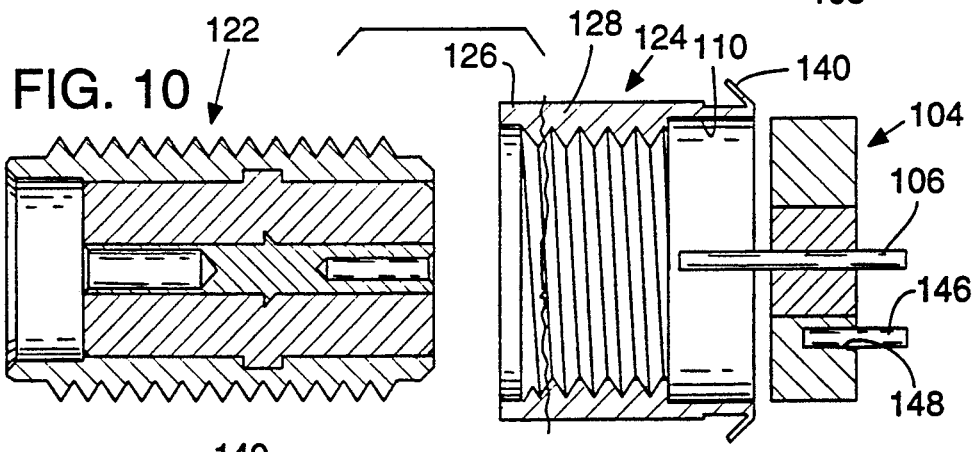
FIG. 10 is a partial cross-sectional, partially exploded view of the embodiment of the present invention shown in FIG. 9, including a grounding shim component and a grounding pin component.
Figure 11:
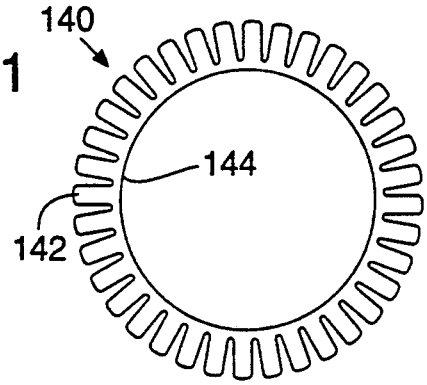
FIG. 11 is a top view of a daisy wheel ground shim useful in embodiments of the present invention.

FIG. 10 shows component 124 of connector 120 including a grounding shim 140 and a grounding pin 146. Either or both of these features may be employed to improve the electrical performance of RF connectors of the present invention. Grounding shim 140 prevents the ground from passing through the laser weld between connector component 124 and the electronics package, thereby preserving a shortened ground path through connector 120. Any convenient configuration of grounding shim 140 may be employed in the practice of the present invention, with a "daisy wheel" configuration as shown in FIG. 11 preferred.

A daisy wheel-type grounding shim 140 is a flexible, spring-like member with a plurality of projections or fingers 142 extending from a circular inner boundary wall 144, which is sized and configured to fit about the circumference of feedthru 104. Grounding shim 140 is formed of a material capable of interfacing with the iron-based metal portion of feedthru 104. Preferably, this material is flexible and laser weldable or solderable to the iron-based metal portion of feedthru 104. For example, grounding shim 140 may be formed of a copper-beryllium alloy, 302 stainless steel or the like.

Upon insertion of the assembly including component 124, grounding shim 140 and feedthru 104 into an electronics package, the extended projections or fingers of grounding shim 140 are bent toward the main body of component 124. In this manner, the discontinuity of the ground signal resulting from the gap between a prior art connector and an electronics package is prevented, and a shortened ground path is therefore maintained.

Alternatively or in addition to grounding shim 140, grounding pin 146 (as shown in FIG. 10) may be employed in the practice of the present invention. A hole 148 is drilled or otherwise generated in the metal portion of feedthru 104, preferably in alignment with the destination of the ground within the electronics package. Grounding pin 146 is inserted in hole 148 and provides a shorter path between feedthru 104 and the ground destination within the electronics package than travel of the ground about the periphery of the electronics package. Because connector component 124 is push-inserted into the electronics package rather than inserted through the application of torque, proper grounding pin 146 alignment is more easily achieved.

Glass-to-metal feedthrus useful in the practice of the present invention are known and commercially available. Glass-to-metal feedthrus formed, for example, from 7070 glass available from Corning Glass Works (Corning, N.Y.) and KOVAR® may be produced substantially as described in U.S. Pat. No. 4,352,951. Size modification of commercial feedthrus may be necessary to best accommodate all applications of the present invention. Such modifications may be made by a practitioner in the art, however.

Laser welding, soldering, brazing or like techniques and equipment may be employed for this purpose, with laser welding preferred. In addition, any known pre- or post-weld or solder production steps may be employed, if desirable for the specific application in which the connector of the present invention is to be used. A practitioner in the art is therefore capable of producing a connector-electronics package interface to form an electronics assembly in accordance with this embodiment of the present invention.

Connector component 124 dimensions are dictated by the electronics package and field replaceable member(s) 122 with which component 124 is to be interfaced in any specific application thereof. Preferably, component 124 is formed of a dissimilar metal sheet having an aluminum layer thickness ranging from about 0.030 in. to about 0.060 in., with about 0.035 in. to about 0.045 in. more preferred, and an iron layer thickness preferably ranging from about 0.190 in. to about 0.220 in., with from about 0.205 in. to about 0.215 in. more preferred. Additional metal layers that may be optionally included in dissimilar metal sheets forming field replaceable RF connectors components 124 useful to accomplish aluminum-to-iron interface are titanium, silver, palladium or the like. Such additional metal layers preferably range from about 0.025 in. to about 0.030 in. in thickness. The total length of RF connector component 124 ranges from about 0.200 in. to about 0.300 in, with about 0.250 preferred as a result of typically employed electronics package wall thicknesses.

These dimensions are within the design parameters of standard RF connectors, allowing the connectors of the present invention to be used in applications requiring such connectors. The same or similar dissimilar metal sheets used in fabricating micro-D and, preferably, unitary RF connectors may be used to fabricate connector component 124 of this embodiment of the present invention. Preferably, the dissimilar metal sheets used in this embodiment of the present invention are formed with aluminum alloy/KOVAR® or aluminum alloy/stainless steel layers, with a significant portion of component 124 preferably formed of KOVAR® or stainless steel to avoid the limitations caused by the military standard regarding iron-based metal-aluminum alloy threaded engagement.

Field replaceable RF connectors 120 fabricated in accordance with the present invention exhibit the following properties: field replaceability; laser weldability; improved electrical performance; higher frequency signal handling capability; and the like.

In operation, the connectors of the present invention provide hermetic feedthrus in a practical and reliable manner. More specifically, the connectors are installed in electronics packages in a manner facilitating electrical signal as well as mechanical integrity over long electronics assembly lifetimes.

The principles of the present invention may also be applied to D.C. signal feedthrus, for example. A "feedthru" is a means of transferring a signal into and out of a location, while a "connector" provides an interface between two components. A D.C. feedthru is generally employed in combination with a cable or mating connector, however. D.C. signals may be carried by apparatus including a ceramic/glass-to-metal seal. A D.C. feedthru of the present invention is structured similarly to connector component 124 shown in FIG. 9, absent the interior threads located on component 124. Using such a feedthru, D.C. signals may be routed to and from an electronics package.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. A connector body suitable for hermetically sealing a first apparatus comprising a first higher density metal and a second apparatus comprising a second lower density metal having thermal expansion properties different from those of the first metal, the connector comprising an integral layered metallic body portion having a first layer comprising a higher density metal that is thermally compatible with and hermetically sealable to the first metal and a second layer comprising a lower density metal that is thermally compatible with and hermetically sealable to the second metal, whereby the first and second layers of the connector body have an unequal volume and the second layer comprising the lower density metal has a larger volume than the first layer comprising the higher density metal.

2. A connector according to claim 1 wherein the first layer comprises aluminum, an aluminum alloy or a metal that has a coefficient of thermal expansion compatible therewith.

3. A connector according to claim 1 wherein the second layer comprises an iron-based metal or a metal that has a coefficient of thermal expansion compatible therewith.

4. A connector according to claim 3 wherein the iron-based metal comprises stainless steel.

5. A connector adapted for installation in a recess in an electronics package constructed from a first material, the connector comprising:

a pin insert having a main body comprising a second material characterized by thermal expansion properties different from the first material and at least one conductive pin penetrating and hermetically sealed to the main body; and a connector body having a first portion and a second portion bonded to one another, the first portion having an inner perimeter corresponding generally to the perimeter of the main body and constructed from a material that is compatible with and hermetically sealable to the second material of the main body, and the second portion having a volume greater than that of the first portion and an outer perimeter corresponding generally to the recess in the electronics package, the second portion constructed from a material that is compatible with and directly hermetically sealable to the first material of the electronics package.

6. A connector according to claim 5 wherein the second portion of the connector body comprises aluminum, an aluminum alloy or a metal that has a coefficient of thermal expansion compatible therewith.

7. A connector according to claim 5 wherein the first portion of the connector body comprises an iron-based metal or a metal that has a coefficient of thermal expansion compatible therewith.

8. A connector according to claim 7 wherein the iron-based metal comprises stainless steel.

9. A connector according to claim 5 formed in a micro-D configuration.

10. A connector according to claim 5 formed in a low profile micro-D configuration.

11. A connector according to claim 5 formed in a unitary radio frequency configuration.

12. A connector according to claim 5 formed in a dual component radio frequency configuration.

13. A connector according to claim 5 further comprising a ground shim to prevent ground signal discontinuity.

14. A connector according to claim 5 further comprising a ground pin to communicate an electrical signal to the electronics package.

15. A connector body according to claim 1 formed in a micro-D configuration.

16. A connector body according to claim 1 additionally comprising a third layer formed from metal that is different from the metals forming the first and second layers.

17. A connector body according to claim 16, wherein the third layer is interposed between the first and second layers.

18. A connector body according to claim 16, wherein the third layer comprises titanium, silver, or palladium.

19. A connector adapted for installation in a recess in an electronics package constructed from a first material, the connector comprising:

a pin insert having a main body comprising a second material characterized by thermal expansion properties different from the first material and at least one conductive pin penetrating and hermetically sealed to the main body; and a connector body comprising at least three different materials, including a first portion comprising a material hermetically sealable to the first material and a second portion comprising a material hermetically sealable to the second material.

* * * * *